US008624118B2

(12) United States Patent
Kauffman

(10) Patent No.: US 8,624,118 B2
(45) Date of Patent: Jan. 7, 2014

(54) WATER-SOLUBLE POLYMER COATING FOR USE ON ELECTRICAL WIRING

(75) Inventor: Robert E. Kauffman, Centerville, OH (US)

(73) Assignee: University of Dayton, Dayton, OH (US)

( * ) Notice: Subject to any disclaimer, the term of this patent is extended or adjusted under 35 U.S.C. 154(b) by 884 days.

(21) Appl. No.: 12/090,659

(22) PCT Filed: Oct. 18, 2006

(86) PCT No.: PCT/US2006/040967

§ 371 (c)(1),
(2), (4) Date: Apr. 18, 2008

(87) PCT Pub. No.: WO2007/047887

PCT Pub. Date: Apr. 26, 2007

(65) Prior Publication Data

US 2008/0210453 A1 Sep. 4, 2008

Related U.S. Application Data

(60) Provisional application No. 60/728,144, filed on Oct. 19, 2005.

(51) Int. Cl.
*H01B 7/00* (2006.01)

(52) U.S. Cl.
USPC ..... 174/120 R

(58) Field of Classification Search
USPC ..... 174/110 R, 120 R
See application file for complete search history.

(56) References Cited

U.S. PATENT DOCUMENTS 3,526,678 A * 9/1970 Snelgrove et al. ..... 525/58
6,180,888 B1 * 1/2001 Yin et al. ..... 174/110 R

FOREIGN PATENT DOCUMENTS

| | | | |
|---|---|---|---|
| CH | 229293 A | | 10/1943 |
| GB | 1 528 221 A | | 10/1978 |
| JP | S50-017672 | | 6/1975 |
| JP | 56-63707 | * | 5/1981 |
| RU | 2 061 732 C1 | | 6/1996 |

OTHER PUBLICATIONS

International Search Report and Written Opinion dated Jun. 19, 2007 pertaining to PCT/US2006/040967.
Office Action pertaining to Canadian Application No. 262563 dated Sep. 14, 2012.

* cited by examiner

*Primary Examiner* — Chau Nguyen
(74) *Attorney, Agent, or Firm* — Dinsmore & Shohl LLP

(57) ABSTRACT

A water-soluble polymer coating for application to electrical wiring used in aircraft and other electrical structures is provided. The coating includes a water-soluble polymer such as polyvinyl acetate, polyvinyl alcohol, and methyl cellulose which is dissolved in water to form a solution. The solution may be applied to electrical wiring during manufacturing and dried to a film such that if the wire becomes damaged and exposed to water, a protective water-insoluble deposit is formed on the wiring. Alternatively, the solution may be applied to wiring which is already damaged to form a protective water-insoluble deposit.

9 Claims, 2 Drawing Sheets

WATER-SOLUBLE POLYMER COATING FOR USE ON ELECTRICAL WIRING

CROSS REFERENCE TO RELATED APPLICATIONS

This application claims priority to and is a national application filed under 35 U.S.C. §371 of PCT international application No. US06/040967 filed Oct. 18, 2006, which claims priority to U.S. provisional patent application Ser. No. 60/728,144 filed Oct. 19, 2005, which is hereby incorporated by reference in its entirety.

This invention was made with government support under Contract No. DTFACT-04-C-00019 awarded by the FAA. The government has certain rights in the invention.

The present invention relates to a water-soluble polymer coating for use on insulated electrical wiring used in aircraft and other electrical structures, and more particularly, to a water-soluble polymer coating which forms a protective water-insoluble deposit on the wire conductor when the wire insulation is damaged and exposed to moisture.

During the lifetime of an aircraft or other structure which utilizes insulated electrical wires, the insulation on the wires can become damaged through a variety of mechanisms including abrasion, hydrolysis, fatigue, chemical reaction and combinations thereof. In such instances, when the conductor portion of the wiring (typically copper) becomes exposed to the environment, it will come into contact with air and moisture, such as water. Examples of such situations include a cold aircraft landing in hot and/or humid conditions, a ship in rough seas, a car running through standing water, buried cable during a rainstorm, house wiring near leaky plumbing, etc.

When water comes into contact with the powered copper conductor, an electrochemical reaction occurs which can produce highly conductive electrolysis deposits and corrosion at the site of the exposed area. Such conductive deposits and corrosion can lead to wiring malfunctions such as shorts, arcing and even potential fires.

Current solutions to this problem have involved the manual application of heat shrinkable tubing or films to the damaged wiring; however, this method is only applicable to accessible wiring and typically requires disassembly of wire bundles, causing the potential for additional damage to adjacent wires.

Accordingly, there is a need in the art for a method of repairing electrical wiring which becomes damaged and exposed to water, which method can be implemented either before or after the damage occurs.

The present invention meets that need by providing a self-repair feature to electrical wiring in aircraft and other electrical structures which can be implemented when the wiring is manufactured or after the wiring has been damaged in use. Where the method is implemented prior to damage, a water soluble polymer is applied as a coating to electrical wiring during manufacturing to form a protective film. If the coated wiring is then subsequently damaged and the powered wiring is exposed to moisture such as water, an electrochemical reaction occurs between the water, the exposed wiring, and the polymer coating which results in the formation of a water-insoluble deposit which forms a protective, nonconductive insulating layer. Thus, the coating provides a "self-repairing" feature for the wiring and is independent of the damage mechanism.

Where the method is used to repair wiring which is already damaged due to, for example, long-term fatigue, chemical degradation (hair-line cracks), short-term abrasions (cuts or gouges) or arcing (evaporation, melting or carbonization), the water soluble polymer is provided as a sprayable or brushable aqueous solution which is applied to the wiring to form a protective water-insoluble film.

The water-soluble polymer coating/solution of the present invention may be used in dc and ac power applications. The coating may be used with wiring which includes any kind of insulation originally incorporated into the wiring, i.e., it is independent from the insulation composition.

According to one aspect of the present invention, an electrical wire or wiring is provided which is coated with a water-soluble polymer solution comprising a water-soluble polymer and water which forms a protective water-insoluble deposit when the wiring becomes damaged and is exposed to water. By "electrical wiring" it is meant any conductor used to carry electricity, which conductor may include an insulating material or protective covering included thereon.

The water-soluble polymer is preferably selected from the group consisting of polyvinyl acetate, polyvinyl alcohol, methyl cellulose, and combinations or copolymers thereof. Where the water-soluble polymer comprises polyvinyl alcohol, the polymer preferably contains from about 0 to 30% acetate groups. The solution preferably comprises from about 10 to 100% by weight of the water-soluble polymer, and more preferably, from about 10 to 30% by weight. The polymer is preferably dissolved in water to form a solution which may be applied to electrical wiring, for example, by brush coating or spraying the solution onto the wiring.

Alternatively, the polymer may be applied to wiring by melting the polymer and applying the liquid polymer to the wiring. Where the polymer is applied to wiring by melting, a film forms after the wiring is cooled.

The water-soluble polymer solution may optionally contain additives which promote crosslinking of the polymer when the polymer is exposed to water (upon damage to the wiring). Such additives are preferably selected from the group consisting of aluminum oxide, ferric oxide, magnesium oxide, sodium tetraborate, boric acid, fumed silica, titanium dioxide, and encapsulated copper. The additives may be added in an amount of about 0 to about 90% by weight of the coating, and more preferably from about 5 to 20% by weight.

In one embodiment of the invention, the water-soluble polymer solution is coated onto the metallic core or conductor of the electrical wiring (typically copper) during manufacturing of the wiring and is dried to form a film. An outer layer of insulating material may be provided over the coated copper wiring. Preferably, the dried film (formed either by coating or melting) has a thickness of greater than about 25 microns.

In another embodiment of the invention, the coated electrical wiring comprises plated copper wire. Such wiring may include nickel-plated wire, silver-plated wire, tin-plated wire, and the like.

In another embodiment of the invention, the coated electrical wiring comprises a twisted wire pair comprising copper wire and an anodic or cathodic metal wire which is capable of forming a galvanic couple with the copper wire. In these embodiments, the water soluble polymer coating is preferably applied to the plated wiring or twisted wire pair and dried or cooled to a film, followed by the application of an insulating material.

In another embodiment of the invention, the coated electrical wiring comprises a copper wire conductor surrounded by an outer anodic metal. In this embodiment, the water soluble polymer solution may be applied either between an insulating layer formed over the coated wire and the outer metal layer and/or between the insulating layer and copper conductor portion of the wiring. In this embodiment, when the outer insulating layer and/or anodic metal layer is damaged such that the copper wire or galvanic couple is exposed, the water-soluble polymer film will dissolve/interact with any water and dissolved metal species present on the damaged area to form a protective insulating deposit.

In yet another embodiment of the present invention, a method of repairing electrical wiring which is already damaged is provided which includes applying a water-soluble polymer in the form of an aqueous solution to at least a damaged portion of powered electrical wiring to form a water-insoluble deposit. In this embodiment, the aqueous solution comprises from about 1 to 30% by weight of the water-soluble polymer. Also in this embodiment, the water-soluble polymer solution preferably further includes a coloring agent such as a dye so that the repaired portion of the wiring is visible for later inspection. The dye is preferred for use in applications where the wiring is readily accessible. The water-soluble polymer solution is preferably applied to the damaged wiring by spraying (preferred when the wiring is relatively inaccessible) or brushing (preferred when the wiring is readily accessible).

Accordingly, it is a feature of the present invention to provide a water-soluble polymer solution for application to electrical wiring during manufacturing and which provides a self-repairing feature, i.e., the formation of an insulating deposit, when the wiring is damaged and the wire or galvanic couple is exposed to water. It is another feature of the invention to provide a water-soluble polymer solution which may be used to repair already damaged wiring. Other features and advantages of the invention will be apparent from the following description and the accompanying drawings.

Figure 1A:
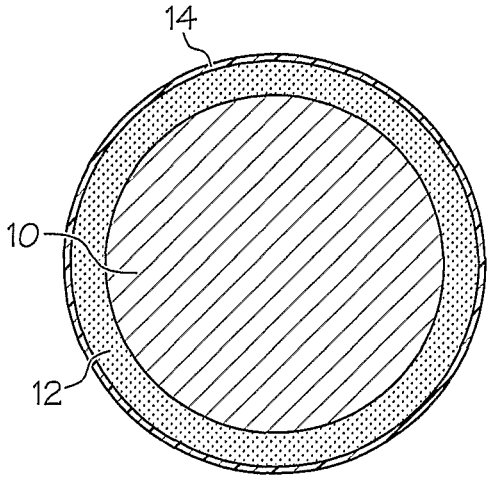
FIG. 1A is a schematic end view of a section of copper wiring which has been coated with the water-soluble polymer solution of the present invention and including an outer insulating layer.

The water-soluble polymer coating of the present invention used as a self-repairing feature for wiring is based on the concept that water soluble polymers such as polyvinyl acetate, polyvinyl alcohol and methyl cellulose form an insulating water-insoluble deposit in the presence of moisture (water) and soluble transition metals such as copper. Thus, when copper wiring is coated with the film-forming water-soluble polymer, if the wiring is subsequently damaged and the copper wire or galvanic couple portion of the wiring is exposed to water, electrolysis or galvanic corrosion occurs at the copper surface, producing soluble copper species which crosslink the water-soluble polymer to form a protective insulating deposit which inhibits further electrolysis of the copper. The insulating deposit initially takes the form of a soft gel which hardens with time and/or further electrolysis.

Preferred water-soluble polymers for use in the coating of the present invention include polyvinyl acetate, polyvinyl alcohol, methyl cellulose, or combinations or copolymers thereof. However, it should be appreciated that any other water-soluble polymers may be used in the present invention as long as they provide the desired insulating deposit. Where the water-soluble polymer comprises polyvinyl alcohol, the polyvinyl alcohol preferably comprises from about 0 to 30% acetate groups.

The water-soluble polymer is preferably dissolved in water to form the solution. The solution may optionally contain additives which promote crosslinking of the polymer when the polymer coating is redissolved by water (after damage occurs) and aid in providing water resistance to the produced water-insoluble polymer film. Suitable additives for use in the invention include, but are not limited to, aluminum oxide, ferric oxide, magnesium oxide, sodium tetraborate, boric acid, fumed silica, titanium dioxide, and encapsulated copper. The additives are preferably added to the solution in an amount of from about 1 to about 20% by weight, and preferably about 5% by weight. Such additives are preferably provided in the form of particles which are dispersed and/or suspended in the solution.

The water-soluble polymer solution is preferably coated onto electrical wiring during the manufacture of such wiring and then dried to form a film. For example, the solution may be sprayed or brushed on a moving wire which is heated to drive off the water prior to the application of insulation. The drying time varies depending on temperature conditions. For example, the coating may dry in about 24 hours at room temperature, or in about 5 minutes at 90° C.

Alternatively, the water-soluble polymer may be applied to wiring by melting. For example, during manufacturing, the liquid polymer may be applied to a moving wire which then forms a coating after the wire cools. It should be appreciated that where the polymer is melted, preferred polymers for use are low molecular weight copolymers such as polyvinyl acetate and polyvinyl alcohol in differing ratios.

The dried film preferably has a thickness of greater than about 25 microns. Once dried, the water soluble coating remains present as a film on the wiring and will only react with water to form the insulating deposit if the outer insulation layer of the wiring is damaged, for example, by cracking or abrading.

Figure 1B:
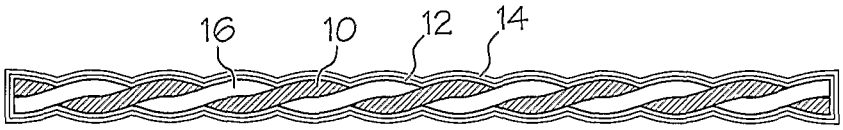
FIG. 1B is a side view of a section of electrical wiring comprising a twisted copper wire/anodic metal wire pair coated with the water-soluble polymer solution of the present invention and including an outer insulating layer.
Figure 1C:
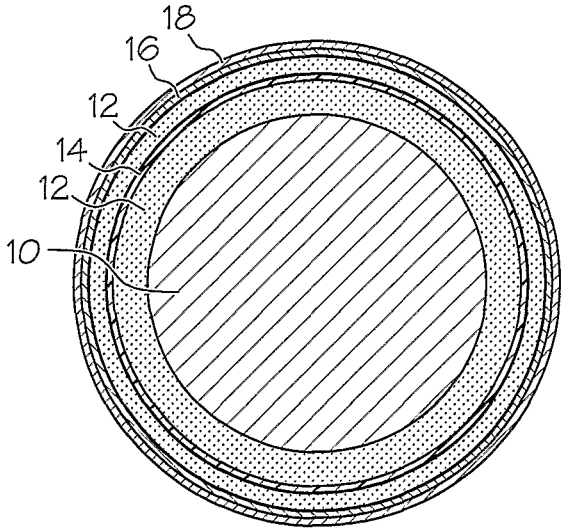
FIG. 1C is a schematic end view of a section of electrical wiring comprising a copper wire covered with an insulating layer, the water-soluble polymer coating, an outer anodic metal layer, and an insulating layer.

Referring now to the drawing figures, FIGS. 1A-1C illustrate the water-soluble polymer coating applied as a solution to wiring as a preventative self-repairing feature.

In the embodiment illustrated in FIG. 1A, the water-soluble polymer solution containing the crosslinking additives may be applied directly to the surface of copper (conductor) wire 10 and dried to form a film 12. The coated wiring is then covered with an insulating material 14.

In another embodiment of the invention illustrated in FIG. 1B, the water-soluble polymer coating is shown on wiring which is comprised of copper wire 10 twisted around an anodic or cathodic metal wire 16 to form a wire pair. The anodic metal wire may comprise low carbon steel or nickel plated copper. The cathodic metal wire may comprise silver, stainless steel, titanium, or Inconel. Any other metals capable of forming a galvanic couple with the copper wire may also be used. The anodic or cathodic metal functions to increase the strength of the wire as compared to the use of copper wire alone. The water-soluble polymer solution forms a film 12 over the twisted wire pair and is then covered with an outer layer of insulating material 14.

In the embodiment illustrated in FIG. 1C, the water-soluble polymer coating 12 is shown on copper wiring 10 which is covered with an insulating layer 14. The water-soluble coating 12 is also preferably included over the insulating layer 14, and an outer layer of an anodic metal 16 is included over the water-soluble coating 12 (similar to EMI shielded wiring applications) which is covered with a second (outer) layer of insulating material 18. The outer anodic metal layer preferably comprises nickel or aluminum, but may comprise any metal capable of forming a galvanic couple with the copper, or any metal which is anodic with respect to copper. In this embodiment, the anodic metal also functions to form a non-conductive, insoluble residue after damage to the insulating layer occurs, which improves the water-insolubility of the water-insoluble deposit formed upon damage to the wiring. It should be appreciated that the corrosion products formed by the galvanic couple when the wiring is damaged aid in crosslinking the water-soluble polymer even when the wiring is unpowered.

Where the water-soluble polymer is applied in the form of a solution for the purpose of repairing already damaged wiring, the method is preferably performed in conjunction with a method for detecting damage to the wiring. For example, bundles of electrical wires to be inspected can be sprayed with water, followed by the application of electrical power. A spectrum analyzer or AM radio can be used to detect RF produced by any electrolysis occurring at exposed conductor surfaces. In areas where RF is detected, the wires and/or bundles can then be sprayed with the water-soluble polymer solution.

In this embodiment, the water-soluble polymer solution preferably comprises from about 1 to 10% by weight of the water-soluble polymer for applications where the solution is applied by spraying. Where the solution is brushed onto damaged wiring, the solution preferably comprises from about 10 to 30% by weight of the water-soluble polymer to provide a solution having a thicker viscosity.

It should be appreciated that while the crosslinking additives described above may be optionally included in the water-soluble polymer solution used for damage repair, they are preferably used in lower amounts than in the solution applied to wiring during manufacturing.

Optionally, an amount of colored dye, for example, red dye No. 40, may be added to the solution to provide a colored water-insoluble polymer coating as an indication of repaired wires for purposes of performing future maintenance. The dye is preferably added at a concentration of, for example, less than 0.1% of a 10% polymer solution such that it comprises less than 1% of the resulting deposit. The self-repaired wiring may then be monitored at determined intervals to ensure that RF is not detected and that the damage remains repaired.

In order that the invention may be more readily understood, reference is made to the following examples which are intended to illustrate the invention, but not limit the scope thereof.

EXAMPLE 1

The use of water-soluble polymers in a solution for providing self-repairing wires was studied using pairs of bare parallel copper wires (1 mm diameter with 10-20 mm length exposed) and a 27 Vdc, 1.5 A power supply. The water-soluble polymers were prepared as 6% solutions in dehumidifier water, with the exception of methyl cellulose, which was prepared as a 3% solution. The polyvinyl alcohol polymers having a degree of hydrolysis greater than 95% required heating to 75° C. and continuous shaking for several minutes to completely dissolve in the water.

First, a water drop was applied to bare parallel copper wires powered by 27 Vdc (simulating electrical wiring with insulation completely removed). Electrolysis of the water produced conductive, copper-containing dendrites. When the dendrites extended across the gap between the wires, they shorted out the circuit and the electrolysis stopped. (In actual use, such short-circuiting may cause control malfunctions, such as in an aircraft).

The various water-soluble polymer solutions were then applied to different pairs of bare parallel copper wires. When a drop of the water-soluble polymer solution was applied to the bare copper wires powered by 27 Vdc (simulating electrical wiring with insulation completely removed), electrolysis of the water produced an insulating, water-insoluble deposit (polymer) on one of the copper wires, inhibiting electrical flow through the water, bridging the wires, and stopping the electrolysis.

Final current levels were measured after 30 minutes using a stripchart and voltmeter.

TABLE 1

Comparison of Electrolysis Results for Water-Soluble Polymers

| Water-Soluble Compounds | Final Current Levels (mA) | RF Produced | Observations |
|---|---|---|---|
| Polyvinyl alcohol: 80% hydrolyzed 89% hydrolyzed 98% hydrolyzed | <2, decreasing | No | Foam from (−) wire, green deposit on (+) wire |
| Poly(acrylic) acid | <5, level | No | Light blue, foam |
| Polyethyleneimine | >50, increasing | No | Deep blue, foam |
| Polyacrylamide | >1000, increasing | Yes | Dark brown, foam |
| Polyethylene oxide | >30, increasing | No | Black deposits, foam |
| Cellulose acetate propionate | <5, level | No | Bubbling, some deposit |
| Methyl cellulose (3%) | <2, decreasing | No | No bubbling, some green deposits |
| Polyvinylpyrrolidone | <2, decreasing | No | No deposits or bubbling |
| Water (no polymer added) | >1,500, shorted (battery maximum) | Yes | Dendrites formed steam, sizzling |

As can be seen, both the polyvinyl alcohol (regardless of hydrolysis level) and methyl cellulose polymer coatings were very effective in inhibiting water electrolysis by the powered Cu wires (water drop still present at end of 30 minute test) as evidenced by the lack of detectable RF, the formation of green insoluble deposits, and the low current levels listed in Table 1.

EXAMPLE 2

Each of the water-soluble polymer solutions of Example 1 was applied to different pairs of parallel, bare copper wires and allowed to dry overnight to form a film/coating. The copper wires were then connected to a 27 Vdc power supply and drops of dehumidified water were applied to the polymer coated wires to see if the polymer films would dissolve and form a water-insoluble deposit. The results are shown in Table 2.

TABLE 2

Comparison of Electrolysis Results for Water-Soluble Polymer Films

| Water-Soluble Compounds | Final Current Levels (mA) | RF Produced | Observations |
|---|---|---|---|
| Polyvinyl alcohol: 80% hydrolyzed 89% hydrolyzed | <3, decreasing | No | Bubbles on the (−) wire, green deposit |

TABLE 2-continued

Comparison of Electrolysis Results for Water-Soluble Polymer Films

| Water-Soluble Compounds | Final Current Levels (mA) | RF Produced | Observations |
|---|---|---|---|
| 98% hydrolyzed | | | on (+) wire |
| Poly(acrylic) acid | >30, increasing | No | Light blue, bubbles |
| Cellulose acetate propionate | >25, level | No | Bubbling, minimal deposit |
| Methyl cellulose (3%) | <3, decreasing | No | No bubbling, some deposits |
| Polyvinylpyrrolidone | >40, increasing | No | No deposits or bubbling |
| Water (no polymer added) | >1,5000, shorted (battery maximum) | Yes | Dendrites formed steam, sizzling |

The results show that the polyvinyl alcohol (regardless of hydrolysis level) and methyl cellulose water-soluble films were capable of inhibiting the Cu/water electrolysis (water drop still present at end of 30 minute test). The polyvinyl alcohol and methyl cellulose films were also the only polymers to form a deposit on the positively charged copper wire during the electrolysis process. For all of the other tested polymers, the initial measured current, the measured RF, and the bubbling at the negatively charged copper wire slowly increased with time as the film slowly dissolved into the water drop. The initial current levels of the polyvinyl alcohol and methyl cellulose polymers leveled off, then decreased with additional reaction time to the readings listed in Table 2. The results in Table 2 suggest that the water-insoluble green deposits formed on the copper wires are responsible for the improved inhibition of the copper water electrolysis by the polyvinyl alcohol and methyl cellulose polymers.

EXAMPLE 3

To test the self-repair capabilities of the polyvinyl alcohol and methyl cellulose water-soluble polymer films formed in Example 2, a razor blade was used to cut through the polyvinyl alcohol and methyl cellulose films along with any green deposit present on the copper (+) wire to expose the underlying copper wires in at least four places (to simulate cracks in outer insulation). Drops of water and 27 Vdc were then applied to the cuts in the coated copper wire pair to determine if the polyvinyl alcohol or methyl cellulose film could repair itself and inhibit the electrolysis of water at the exposed copper surfaces. Upon the addition of the water drop to the cut film, the initial electrolysis which occurred at the exposed cuts was quickly inhibited (current decreased, RE also decreased), i.e., the water-soluble polymer film was able to "self-repair" the cuts by swelling and/or redissolving to react with dissolved Cu species to form water-insoluble deposits.

In another test of the self-repair capabilities of the polyvinyl alcohol and methyl cellulose polymer films, a razor blade was used to scrape layers of dried film from the copper wire pair, exposing 1 mm lengths of each Cu wire (to simulate abrasion of the outer insulation). Drops of water and 27 Vdc were then applied to the exposed Cu wires to determine if the remaining polyvinyl alcohol or methyl cellulose polymer film could repair itself and inhibit the electrolysis of water by the exposed Cu surfaces. Upon the addition of the water drop onto the scraped water-soluble polymer film, the initial electrolysis that occurred at the exposed wires was inhibited (current decreased, RF also decreased) within 10 minutes, i.e., the water-soluble film was able to self-repair the scrapes by redissolving to react with dissolved Cu species to form a water-insoluble deposit on the scraped section of the positively charged Cu wire.

As a final test of the self-repair capabilities of the polyvinyl alcohol and methyl cellulose water-soluble polymer films, the cut tests described above were repeated with drops of acidic salt water (5% sodium chloride and 5% acetic acid). The acidic salt water was used to greatly increase the conductive species in the water drop and the rate of the resulting electrolysis reaction occurring at the exposed Cu surfaces (in separate tests with bare Cu wire pairs and Kapton® HN films, drops of the acidic salt water with 27 Vdc power produced high levels of RF and hot spots that initiated carbon tracking of the Kapton HN film).

Drops of acidic salt water and 27 Vdc were then applied to the cuts in the coated Cu wire pair to determine if the polyvinyl alcohol or methyl cellulose film could repair itself and inhibit the accelerated electrolysis of water by the exposed Cu surfaces. Upon the addition of the acidic salt water drop onto the cut water-soluble polymer film, the accelerated electrolysis which occurred at the exposed cuts was quickly inhibited (current decreased, RF also decreased). As opposed to the other tests, the current increased slightly (rate of electrolysis increased) after 10 minutes, then decreased for the remaining 20 minutes of the test, i.e., even in the presence of the highly conductive salts and acids, the water-soluble polymer film was able to self-repair the cuts by swelling and/or redissolving to react with dissolved Cu species to form a water-insoluble deposit.

It can be seen from the results in Tables 1 and 2 that the polyvinyl alcohol and methyl cellulose water-soluble polymer coatings are capable of providing a self-repair feature to copper electrical wires in which insulation has been damaged. Elemental surface analyses of the green film formed on the Cu wires showed that the produced deposits contain Cu. It is believed that cross-linking of the hydroxyl groups of the adjacent polyvinyl alcohol or methyl cellulose molecules by the Cu species is responsible for the formation of the insoluble deposit on the wire.

EXAMPLE 4

Water-soluble polymer solutions were prepared containing 6% polyvinyl alcohol polymer and 1% of a number of different crosslinking additives dissolved or suspended in the coatings. The various solutions were then applied to bare parallel Cu wires and powered with 27 Vdc power. The results are shown below in Table 3. Final current levels were measured 30 minutes after applying drops of the solution.

TABLE 3

Comparison of Electrolysis Results for polyvinyl alcohol solutions containing various additives

| Inorganic Additives Suspended Powder/ Water-Soluble | Final Current Levels (mA) | Observations |
|---|---|---|
| Aluminum nitrate (soluble) | >200, increasing | Brown residue |
| Aluminum oxide (<12 μm) | <3, decreasing | Green deposit (+) wire |
| Ferric oxide (−325 mesh) | <20, decreasing | Green deposit (+) wire |
| Ferric sulfate (soluble) | >1000, increasing | Crust formed |
| Magnesium oxide (−325 mesh) | >30, increasing | Black deposits, foam |
| Sodium ethylenediamine-tetraacetate (soluble) | >1,000 increasing | Heavy bubbling, no green |

TABLE 3-continued

| Comparison of Electrolysis Results for polyvinyl alcohol solutions containing various additives | | |
|---|---|---|
| Inorganic Additives Suspended Powder/ Water-Soluble | Final Current Levels (mA) | Observations |
| | | deposit (+) wire |
| Sodium tetraborate (soluble) | <3, decreasing | Solution viscous |
| Silica, fumed (<1 μm) | <1, decreasing | Green deposit (+) wire |
| Titanium dioxide (<5 μm) | <2, decreasing | Green deposit (+) wire |
| Polyvinyl alcohol (neat) | <2, decreasing | Foam from (−) wire Green deposit (+) wire |

The results indicate that several inorganic additives may be added to water-soluble polymer solutions to improve the physical characteristics of the resulting water-soluble film without hindering the capability of the polymer (polyvinyl alcohol) to inhibit the Cu water electrolysis process (water drop still present at end of 30 minute test). It can be seen that soluble salts such as aluminum nitrate increase the conductivity of the polyvinyl alcohol solution and that salts such as sodium ethylenediaminetetraacetate, which chelate the Cu electrolysis products decrease the electrolysis inhibiting capabilities of the polyvinyl alcohol. The fact that Cu chelation reduces the capability of polyvinyl alcohol to inhibit electrolysis also suggests that the ability of Cu electrolysis to crosslink adjacent polyvinyl alcohol molecules is responsible for the formation of the water-insoluble deposit of the (+) charged Cu wire.

EXAMPLE 5

To test the ability of the water-soluble polymer films to self-repair damaged insulation on electrical wiring having the configuration shown in FIG. 1A, a twisted Cu wire was coated with a 10% polyvinyl alcohol solution containing 1% fumed silica and 0.05% red dye No. 40, and was dried to form a 20-50 micron thick polymer film. After the polymer film was dry, a single-sided polyimide tape was wrapped around the coated wire to produce a self-repairing wire prototype. A 27 Vdc, 1.5 A power supply was applied. Cuts were then made in the polyimide tape and underlying polymer coating as the first self-repair evaluation. Upon the addition of water drops onto the cut polyimide tape, the initial electrolysis which occurred at the exposed cuts (indicates water reached surface of copper conductor) was quickly inhibited (current decreased, RF also decreased), i.e., the water-soluble polymer film was able to "self-repair" the cuts by swelling and/or redissolving to react with dissolved Cu species to form water-insoluble deposits in the cuts of the polyimide tape.

In a more severe test of the self-repair capabilities of the self-repairing wire prototype, a razor blade was used to scrape away the polyimide tape and underlying layers of dried polymer film from the copper wire pair, exposing 1 mm lengths of each Cu wire (to simulate abrasion of the outer insulation). Drops of water and 27 Vdc were then applied to the exposed Cu wires to determine if the remaining polyvinyl alcohol film could repair itself and inhibit the electrolysis of water by the exposed Cu surfaces. Upon the addition of the water drop onto the scraped water-soluble polymer film, the initial electrolysis that occurred at the exposed wires was inhibited (current decreased, RF also decreased) within 10 minutes, i.e., the water-soluble polymer film was able to self-repair the scrapes by redissolving to react with dissolved Cu species to form a water-insoluble deposit on the scraped section of the positively charged Cu wire. When the damaged wire was powered with 27 Vac, the insoluble polymer formed on both wires.

It can be seen from these results that the polyvinyl alcohol water-soluble polymer coating is capable of providing a self-repair feature to copper electrical wires. Elemental analyses of the insoluble film formed on the Cu wire showed that the produced insoluble deposits contained Cu and Si. It is believed that crosslinking of the hydroxyl groups of the adjacent polyvinyl alcohol molecules by the Cu and Si species are responsible for the formation of the insoluble deposit on the wire.

EXAMPLE 6

Figure 2A:
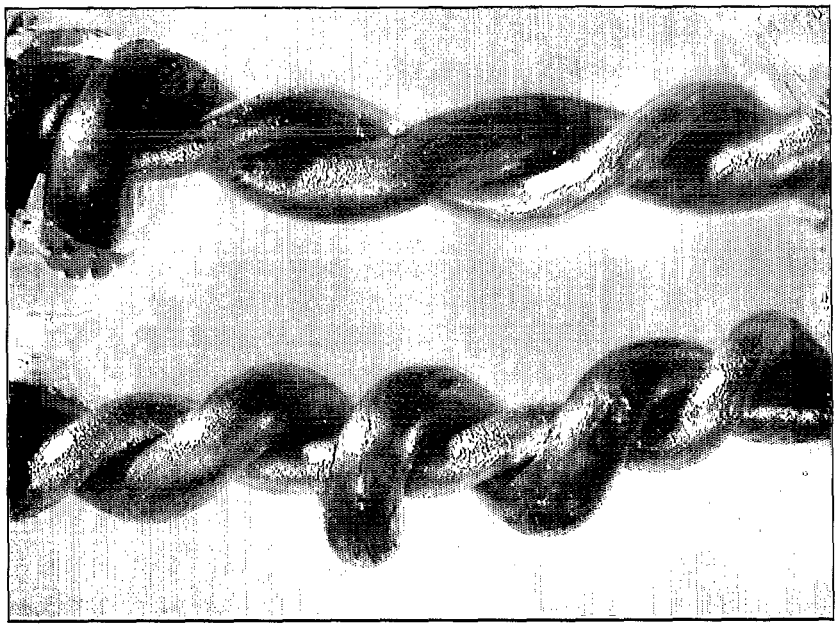
FIG. 2A is a photograph of copper wire twisted with galvanized steel wire.
Figure 2B:
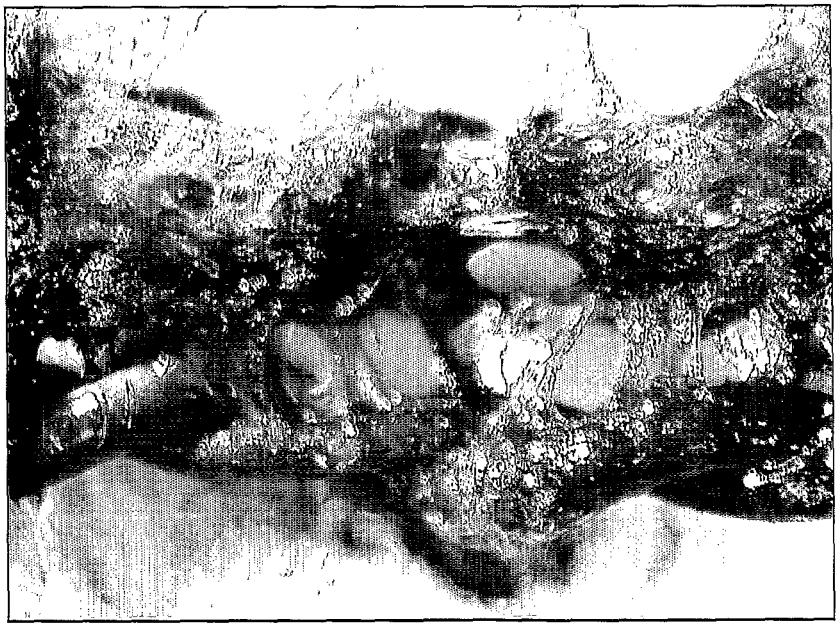
FIG. 2B is a photograph of the powered twisted wire pair of FIG. 2A after being coated with the water-soluble polymer solution and subjected to cuts and addition of water drops to produce water-insoluble deposits.

To test the capability of the water-soluble polymer films to repair insulation-damaged electrical wiring having the configuration shown in FIG. 1B, a Cu wire was twisted with a galvanized steel wire as shown in FIG. 2A. The twisted Cu/steel wiring was coated with a 10% polyvinyl alcohol solution that dried to form a 25-50 micron thick polymer film. Two sets of twisted wires were placed parallel to simulate wiring with the insulation completely removed. A 27 Vdc, 1.5 A power supply was applied to the wire pair. Cuts were then made in the polymer coating as the self-repair evaluation. Upon the addition of several water drops onto the water-soluble polymer film, the initial electrolysis that occurred at the exposed wires was inhibited (current decreased to below 1 mA, RF also decreased) within 10 minutes as a water-insoluble polymer deposit was formed on and between both twisted wires as shown in FIG. 2B.

EXAMPLE 7

To test the capability of the water-soluble polymer films to self-repair the insulating damage of electrical wiring having the configuration shown in FIG. 1C, a Cu wire was placed parallel to an aluminum wire with the insulation completely removed. A layer of water-soluble polymer film (100 micron thickness) was deposited between the wires by applying a 10% polyvinyl alcohol solution followed by drying. A 27 Vdc, 1.5 A power supply was applied (copper wire negatively charged and aluminum positively charged) to the wire pair. Upon the addition of several water drops onto the water-soluble polymer film, the initial electrolysis which occurred at the exposed wires was inhibited (current decreased to below 0.5 mA, RF also decreased) within 5 minutes as the water-insoluble polymer formed between as well as on both wires.

The elemental analyses of the insoluble green residue formed on/between the Cu/aluminum wire pair detected similar concentrations of Cu and aluminum. As aluminum wire undergoes surface passivation, producing nonconductive aluminum species in water, the presence of the water-soluble film promotes the corrosion of the aluminum wire. The resulting (nonconductive) aluminum oxides/hydroxides which are produced aid in crosslinking the polyvinyl alcohol to form the water-insoluble polymer deposit, inhibiting corrosion of the Cu wire (preferable since current is carried by Cu wire, not by aluminum film).

Having described the invention in detail and by reference to preferred embodiments thereof, it will be apparent that modifications and variations are possible without departing from the scope of the invention.

The invention claimed is:

1. Electrical wiring comprising a conductor, said conductor including a dried water-soluble polymer coating directly thereon consisting of a water-soluble polymer and an optional crosslinking additive, said wiring further including an insulating material directly on said coating; wherein when said wiring is damaged and becomes exposed to water, a metal species is formed which crosslinks said water-soluble polymer and forms a protective water-insoluble insulating deposit on said conductor.

2. The coated wiring of claim 1 wherein said water soluble polymer is selected from the group consisting of polyvinyl acetate, polyvinyl alcohol, methyl cellulose, and combinations or copolymers thereof.

3. The coated wiring of claim 2 wherein said water-soluble polymer comprises polyvinyl alcohol.

4. The coated wiring of claim 2 wherein said water-soluble polymer comprises polyvinyl alcohol and contains from about 0 to 30% acetate groups.

5. The coated wiring of claim 2 wherein said water-soluble polymer comprises methyl cellulose.

6. The coated wiring of claim 1 wherein said water-soluble polymer coating comprises from about 10 to 100% by weight of said water-soluble polymer.

7. The coated wiring of claim 1 wherein said water-soluble polymer coating has been applied to at least a portion of the surface of said conductor and dried to form a film having a thickness of greater than about 25 microns.

8. The coated wiring of claim 1 wherein said conductor is selected from the group consisting of copper wire, plated copper wire, copper wire surrounded by an outer anodic metal, and a twisted wire pair comprising copper wire and an anodic or cathodic metal wire.

9. The coated wiring of claim 1 wherein said crosslinking additive is selected from the group consisting of aluminum oxide, ferric oxide, magnesium oxide, sodium tetraborate, boric acid, fumed silica, titanium dioxide, and encapsulated copper.

* * * * *